US006390675B1

(12) United States Patent
Jardine

(10) Patent No.: US 6,390,675 B1
(45) Date of Patent: May 21, 2002

(54) BAG

(76) Inventor: Mark Hamilton Jardine, Grove Farm, Creeting St. Peter, Needham Market, Ipswich IP6 8QG (GB)

( * ) Notice: Subject to any disclaimer, the term of this patent is extended or adjusted under 35 U.S.C. 154(b) by 0 days.

(21) Appl. No.: 09/600,055

(22) PCT Filed: Jan. 6, 1999

(86) PCT No.: PCT/GB99/00037

§ 371 Date: Jul. 6, 2000

§ 102(e) Date: Jul. 6, 2000

(87) PCT Pub. No.: WO99/35058

PCT Pub. Date: Jul. 15, 1999

(30) Foreign Application Priority Data

Jan. 7, 1998 (GB) ..... 9800149

(51) Int. Cl.[7] ..... B65D 33/10
(52) U.S. Cl. ..... 383/24; 383/7; 493/226
(58) Field of Search ..... 493/226; 383/22, 383/24, 7, 8

(56) References Cited

U.S. PATENT DOCUMENTS

| | | | | | |
|---|---|---|---|---|---|
| 1,512,053 | A | * | 10/1924 | Ridlinghafer | 383/13 |
| 4,300,608 | A | * | 11/1981 | Cuthbertson | 383/24 |
| 4,457,456 | A | * | 7/1984 | Derby et al. | 222/105 |
| 4,499,599 | A | * | 2/1985 | Polett et al. | 383/24 |
| 4,597,749 | A | * | 7/1986 | O'Brien et al. | 383/8 |
| 4,759,473 | A | * | 7/1988 | Derby et al. | 383/24 |
| 4,792,171 | A | | 12/1988 | Lamy | 294/68.3 |
| 5,607,237 | A | * | 3/1997 | LaFleur | 383/22 |
| 5,842,789 | A | * | 12/1998 | Derby et al. | 383/24 |
| 5,865,540 | A | * | 2/1999 | Derby et al. | 383/24 |
| 5,993,062 | A | * | 11/1999 | Shakleton | 383/24 |

FOREIGN PATENT DOCUMENTS

| | | |
|---|---|---|
| EP | 0 259 230 A1 | 3/1988 |
| FR | 1 443 272 | 12/1966 |
| FR | 2 306 134 | 10/1976 |
| FR | 2 608 138 | 4/1988 |
| FR | 2 721 304 | 12/1995 |
| GB | 1097040 | 12/1967 |
| GB | 1468902 | 3/1977 |
| GB | 1459448 | 8/1979 |
| GB | 2 050 298 A | 1/1981 |
| GB | 2 092 990 A | 8/1982 |
| GB | 2 097 755 A | 11/1982 |
| WO | WO 97/37908 | 10/1997 |

* cited by examiner

*Primary Examiner*—Stephen P. Garbe
(74) *Attorney, Agent, or Firm*—O'Keefe, Egan & Peterman, LLP

(57) ABSTRACT

A collapsible bag (2) for the storage and transport of bulk materials comprises a bottom panel (13), a plurality of side panels (11, 12), and a pair of substantially parallel tubular guide members (4). The guide members (4) are secured on or adjacent to the tops of at least some of the side panels (11, 12). The tubular members (4) are resilient and connected together by rigid spacing means (22) at or adjacent to their ends. The invention also provides a method for manufacturing the bag and a device for modifying a conventional bag to make a bag in accordance with the invention.

15 Claims, 2 Drawing Sheets

BAG

BACKGROUND OF THE INVENTION

1. Field of the Invention

The present invention relates to a bag, particularly to a bag for bulk storage and transport of materials, notably particulate solids materials. The invention also provides a device for modifying conventional bags.

2. Description of the Prior Art

Bags for storage and transport of bulk materials, for example half-tonne, one-tonne, or two-tonne capacity bags, are typically of generally cuboid shape, formed from a fabric material such as polypropylene. Typically, the weight of fabric material will be from about 180 g/m$^2$ to 400 g/m$^2$ depending on the intended load and operating conditions. The fabric may be reinforced for extra strength.

The bags have a top which is either permanently fully open or which can be opened, for loading. The bottoms of the bags are typically provided with a discharge spout through which the contents of the bag can be emptied when the spout is opened. Alternatively, the base of the bag may be openable for discharge of the contents.

To enable such bags to be lifted and manoeuvred by a fork-lift truck, each bag is typically provided with a lifting loop at each corner. To lift a filled bag, a fork-lift operator brings the tines of the fork close to the top of one edge of the filled bag so that each tine is adjacent to a lifting loop. An assistant lifts up each lifting loop to enable a tine to pass through the loop while the operator moves the tines forward over the bag. The fork-lift operator moves the tines further over the top of the bag until the tines are adjacent the rear pair of lifting loops, and the process is repeated so that the tines are disposed through the rear lifting loops. The bag can then be lifted and moved.

A problem with this procedure is that there is a danger of injury to the assistant when the tines or the fork are moved. This is a particular problem when filled bags are stacked high, on top of each other. The fork-lift operator is unable to see the rear pair of lifting loops when the stack is too high, and the assistant may be injured by a tine or pushed off a ladder. It is also costly to employ two men to secure the bag on the fork.

If no assistant is present, the fork-lift operator must move the truck so that the tines of the fork are positioned near the front loops. He must then get out of the cab of the truck, hook the front loops over the tines, and get back in the cab. He must then drive the truck forward as far as he thinks necessary, get out again, hook the rear loops onto the tines (if he has judged the forward distance correctly), get back in the cab, drive further forward to pick up the bag. The procedure is slow and can be dangerous.

To facilitate lifting of a bag, it has been proposed in EP 0 259 230 to provide a rigid tubular cruciform structure to be secured in the loops of a bag so that pairs of tubes can receive the tines of a fork. In FR 2 721 304 it has been proposed to provide a similar disposable structure made of cardboard. To reduce the load to which lifting loops are subjected it has been proposed to provide bags with integral lifting slings along opposite top edges so that the load is spread out along those edges; see for example GB 1 549 448, GB 2 050 298, and GB 2 092 990. However, the use of such slings does not remove the need for a fork-lift operator either to leave the cab of his truck or to use an assistant to hook the tines of the fork-lift in the slings.

SUMMARY OF THE INVENTION

According to an aspect of the present invention there is provided a collapsible bag for the storage and transport of bulk materials, as specified in claim 1.

Another aspect of the invention provides a collapsible bag for the storage and transport of bulk materials.

Resilient tubular members function as guides for the tines of a fork-lift so that, once the tines have been inserted into one end of the tubular member, full insertion of the tines through the tubular members can be accomplished with-out an assistant and without the need for a fork-lift truck operator to leave the truck.

Because the tubular members are resilient, they lie flat when under load, for example when other filled bags are stacked on top, but revert to a predetermined sectional shape when the-load is removed. This allows stacking of bags without significant wasted space, and permits lifting and moving of the bags by a fork-lift operator without an assistant.

Rigid connection of tubular members ensures that they are spaced apart from each other by a predetermined distance so that the tines of a fork, suitably spaced apart, can be inserted into the tubular members without undue difficulty. The term "rigid" is used herein to denote a linkage which is sufficiently stiff to maintain the necessary separation between the tubular members. The skilled person will therefore appreciate that the spacers therefore need not be totally unyielding, particularly where the tubular members are dimensioned to allow some tolerance for receiving the tines of a fork-lift. The spacers may be made from any suitable structural material. Suitable materials include metals or structural plastics materials, for example nylon or an injection-moulded plastics material.

The tubular members may carry load along their length when the filled bag is suspended, or strong points in the tubular members may take the load of a filled bag, so that other regions of the tubular members need not be substantially load carrying.

The tubular members may be secured in relation to the top edges of at least some of the side panels by direct attachment to the edges, for example by sewing, gluing or riveting, or they may be formed integrally with the edges as will be further described below.

Alternatively, the tubular members may be secured in relation to the edges by means of lifting loops on a conventional bag.

In a particularly preferred embodiment, the bag is formed from a conventional bag with a lifting loop at each corner, by fitting an insert to the bag and securing it by means of the lifting loops. The insert comprises a pair of substantially parallel resilient tubular members which are connected together at or adjacent to each end by rigid spacing means. To provide strong points, it is preferred that the tubular members have laterally extending slots or apertures on their upper surfaces for receiving the lifting loops, and the tubular members are of sufficient size that at least the top portion of each loop is disposed inside a tubular member when the insert is fitted on the bag. The tubular members thus function as guides for the tines of a fork-lift, but the lifting loops take the load when the bag is lifted on the tines.

Accordingly, another aspect of the present invention comprises a device for securing to a bag for the storage and transport of bulk materials, as specified in claim 11.

The tubular members may be made from any suitable resilient material, for example a natural or synthetic rubber material. A preferred material is vulcanised rubber, or the sort of rubber that Wellington boots are typically made from.

The inside surfaces of the tubular members may optionally be provided with a tough coating to confer resistance to cutting and scratching by the tines of a fork-lift.

It will be appreciated that the tubular members may be of any cross sectional shape which will accept the tines of a fork-lift or the like. For example the tubular members may be circular, rectangular, square or oval in cross section. For convenience hereinafter, the invention will be described with reference to tubular members which are substantially circular in section. However, it is to be understood that the invention is not limited to this embodiment.

The tubular members may be of any suitable diameter to receive a tine of a fork-lift, for example they may have a diameter in the range 100 to 300 mm, notably about 200 mm.

Although it is preferred to make the bag by modifying an existing conventional bag as described above, the bags can be made by other methods. For example, the tubular members may be manufactured separately and subsequently secured to opposite top edges of the box by securing means, for example stitching. The rigid connecting means may be secured to the tubular members either before or after the tubular members are secured to the edges of the box. In another embodiment, the tubular members are formed from the material of the bag so that the tubular members are integral parts of the bag. This may be achieved, for example, by forming the bag with a pair of opposed sides which are longer than the other pair of opposed sides, and forming the extra length into tubes. A preferred material is polypropylene fabric. The tubular members may be reinforced by incorporation of a rubber material, to impart resilience. The rubber material may be secured to the tubular members by any suitable securing means, for example stitching or gluing.

Accordingly, a further aspect of the invention provides a method of manufacturing a collapsible bag for the storage and transport of bulk materials as specified in claim 13.

Resilience may also be imparted by reinforcing the tubular member with a suitable reinforcing member, for example a wire of metal or plastics material which is helically wound around the tubular member.

Additionally or alternatively, the tubular members may be placed on a former to define a preferred shape and/or configuration, and sprayed with a fluid material that dries to a form-retaining coating to retain them in that preferred shape and/or configuration. The fluid material may be a foam or a lacquer.

BRIEF DESCRIPTION OF THE DRAWINGS

The invention will now be further described, by way of example, with reference to the following drawings in which.

DETAILED DESCRIPTION OF THE INVENTION

Figure 1:
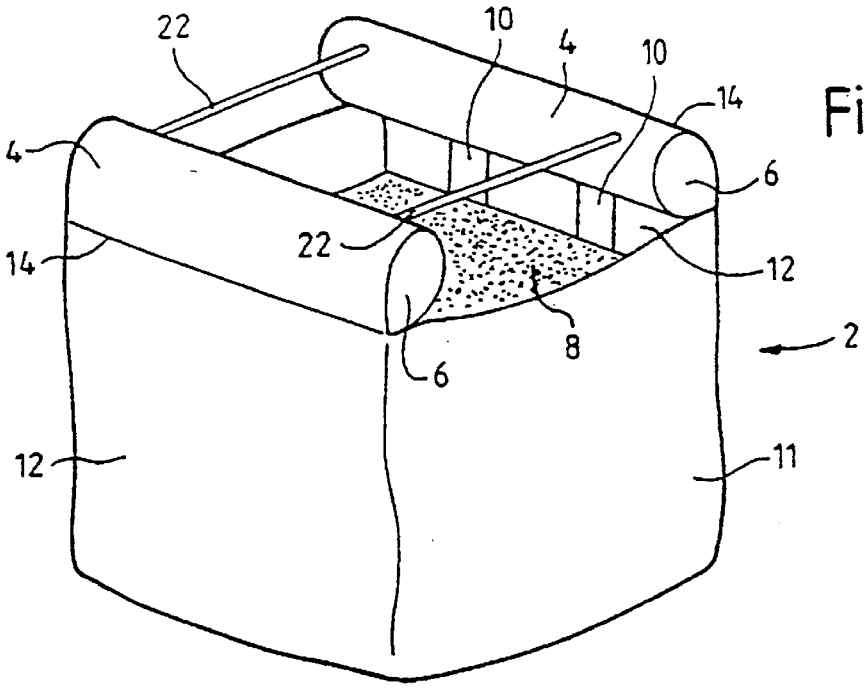
FIG. 1 is a view of a bag in accordance with one aspect of the present invention.

The collapsible bag 2 is-formed from a structural fabric, in this example, polypropylene fabric of weight 300 g/m$^2$. The weight of fabric used will, of course, depend on the maximum load which is to be carried by the bag 2. Methods of assembling suitable fabrics into a bag capable of carrying a load of particulate solids materials 8 are well known to those skilled in the art.

The bag 2 is of a cuboid shape with a generally square plan section bottom panel 13. The bottom panel 13 will have a discharge spout (not shown) for emptying the contents. The bag 2 has pairs of opposed side walls 11, 12. Opposed walls 12 of the bag 2 have top edges 14, each of which is provided with a tubular member 4 secured to the edge 14 and extending along a substantial length thereof. In this example a tubular member 4 is disposed along the entire length of each top edge 14.

Each tubular member 4 is provided with a pair of straps 10 which are secured to the inner surface of the opposed walls 12 by securing means, in this example, stitching.

The tubular members 4 are connected together by a pair of substantially rigid spacers 22 which serve to maintain the tubular members 4 in a configuration wherein their longitudinal central axes are substantially parallel. Thus if the tine of a fork-lift is inserted into an end opening 6 of each tubular member 4 so that the longitudinal axis of the tine is substantially parallel to or collinear with the longitudinal central axis of the tubular member 4, the tine may be pushed forwards through the tubular member 4 to its fullest extent.

The tubular members 4 are resilient, so that they adopt a substantially circular cross sectional configuration in the absence of an applied load. This ensures that each tubular member 4 is open to receive a tine of a fork-lift when the bag 2 is on top of a pile.

A fork-lift operator can insert the tines of his fork-lift into the tubular members 4, lift, move, and lower the filled bag 2, and remove the tines of the fork from the tubular members 4, without leaving his cab and without external assistance.

Figure 2:
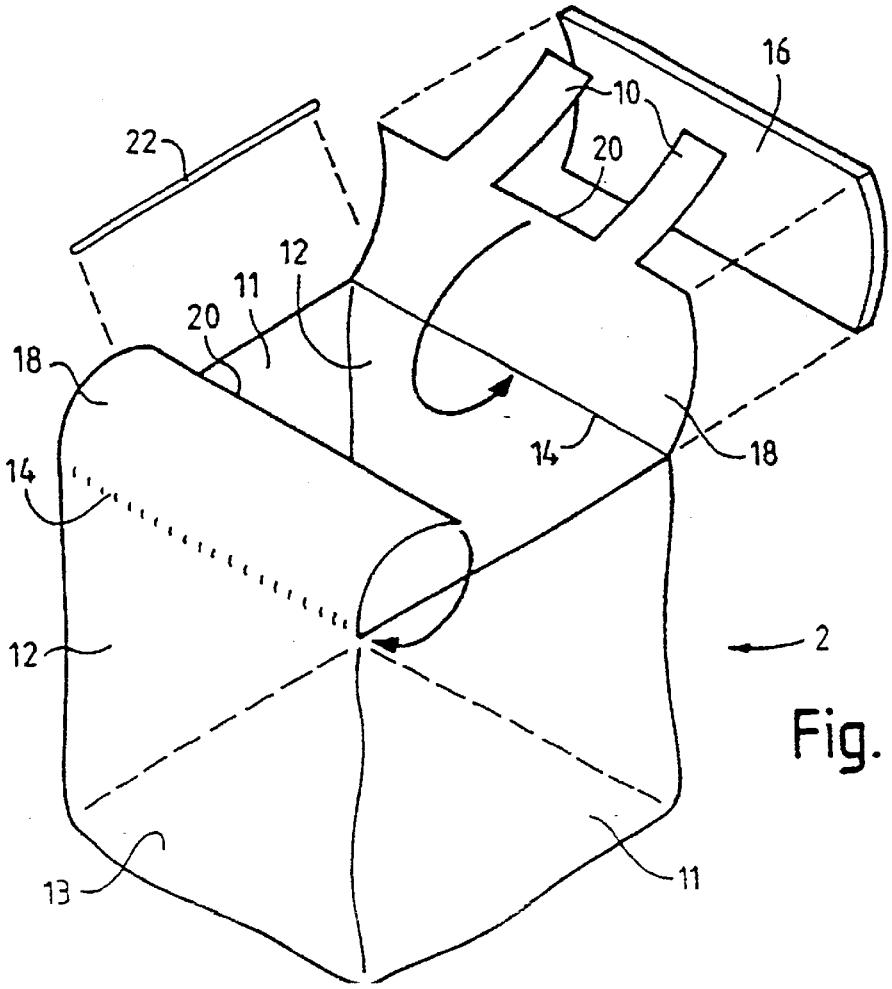
FIG. 2 shows a stage in the manufacture of the bag of FIG. 1.

FIG. 2 shows one step in a method of manufacturing the bag 2. The bag is fabricated by well known methods, but leaving one pair of opposed walls 12 with an additional length of fabric in the form of a flap 18. Each flap 18 is secured along a line defining an edge 14 by securing means, in this example by stitching, as shown by the arrows. The straps 10 are sewn to the insides of the respective opposed walls 12 for reinforcement.

A rubber sheet 16 is secured to each tubular member 4, formed from the flap 18, by suitable securing means, for example gluing or stitching. The rubber reinforcement 16 imparts resilience to the tubular member 4.

Finally, the tubular members 4 are connected together at each end by a pair of substantially rigid spacer rods 22, in this example made of nylon, which are secured to the tubular members 4 by any suitable fixing means, for example by means of glue.

For simplicity, only a single rubber sheet 16, a single rod 22, and a single pair of reinforcing straps 10 are illustrated, but it is to be understood that in this example the finished bag is substantially symmetrical about either central vertical plane normal to a wall of the bag.

Figure 3:
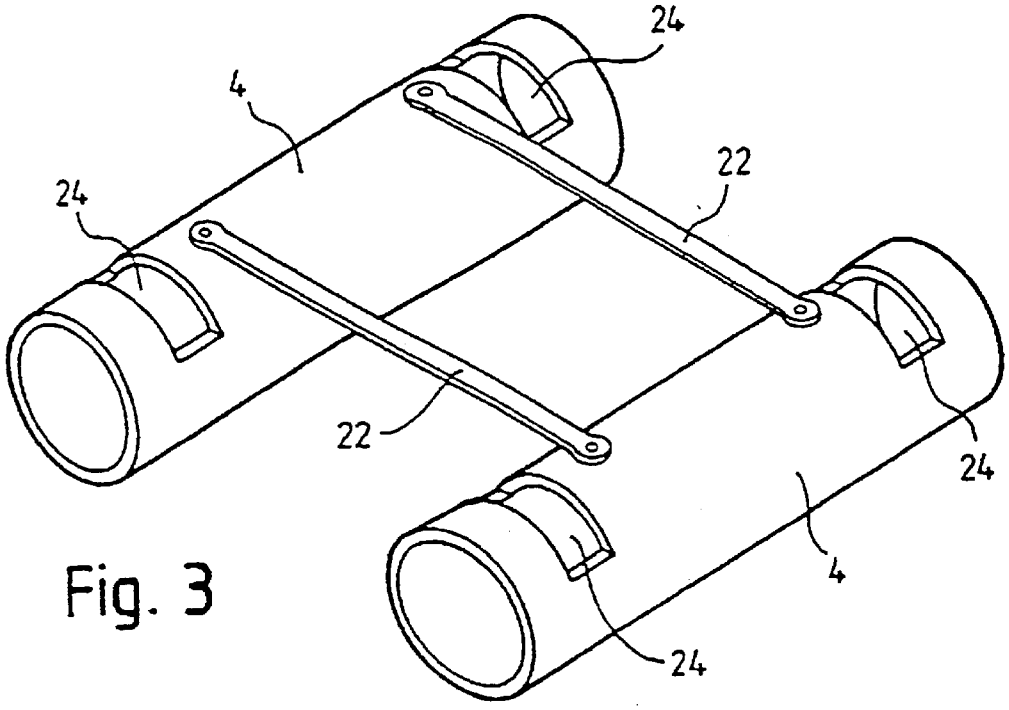
FIG. 3 is a perspective view of a device for modifying a conventional bag.

Turning now to FIG. 3, a device for modifying a conventional bag with a lifting loop at each corner comprises a pair of substantially parallel resilient tubular members 4 connected together by a pair of rigid spacing rods 22 adjacent each end. The rods need to be spaced sufficiently far apart to permit filling of a bag through an area between them when the device is mounted on a bag. Each tubular member 4 is provided with a lateral slot or cut-out portion 24, through which a lifting loop of a bag will be disposed. The slot 24 is here shown having a long axis normal to the long axis of the tubular member 4. It will be understood that the slots may be other shapes and orientations providing that sufficient lateral access is presented for a lifting loop to be retained in the slot when appropriately presented.

Figure 4:
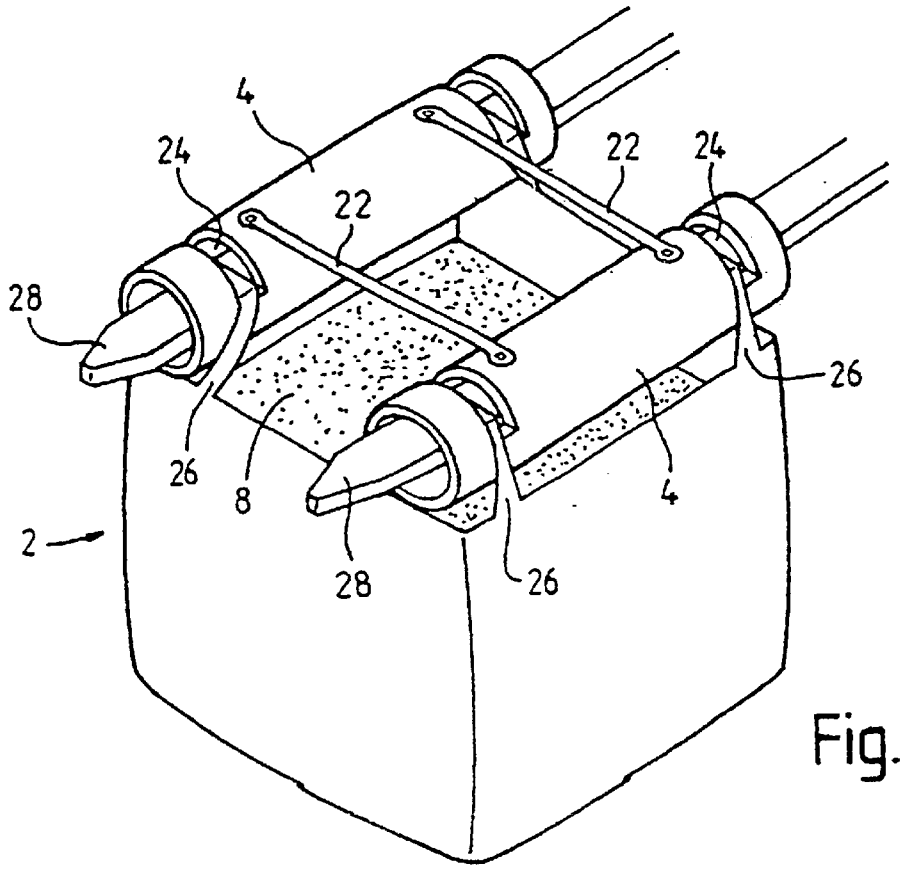
FIG. 4 shows the device of FIG. 3 mounted on a bag, being lifted by a fork-lift.

FIG. 4 shows the device of FIG. 3 in use, mounted on a conventional bag 2 with a strap or lifting loop 26 at each top corner. Each lifting loop 26 is disposed around a tubular member 4 and locates in a cut-out portion 24. The tines 28 of a fork-lift can readily enter the tubular members 4 and the weight of the bag is supported entirely by the lifting loops 26. The tubular members 4 act as guides for the tines 28 but do not support load. The ends of the tubular members 4 project beyond the edges of the bag 2, so that if a plurality of bags are stacked on top of each other, the middle regions of the resilient tubular members 4 are squashed by the resulting load, but the ends remain open. The end portions of the tubular members 4 therefore always retain the preferred sectional shape regardless of whether the middle of the tubular members 4 are squashed, and this helps the tubular members 4 to return quickly to their tubular shape when a load is removed.

The invention provides a bag which can be moved and lifted by a single fork-lift truck operator without external help. Filled bags can be moved more safely than conventional bags, and with less manpower.

Although the invention has been described with reference to one pair of tubular members, it is to be understood that the invention is not limited to this embodiment. It would also be possible to provide a tubular member along each top edge of the bag, to allow a fork-lift to engage with the bag from any of four directions.

What is claimed is:

1. A collapsible bag for the storage and transport of bulk materials, comprising a bottom panel, a plurality of side panels, and a pair of substantially parallel tubular guide members secured on or adjacent to the tops of at least some of the side panels and connected together by rigid spacing means at or adjacent to their ends, characterised in that the tubular members are resilient so that they lie flat when under load but revert to a predetermined sectional shape when the load is removed.

2. A bag as claimed in claim 1, wherein the tubular members are secured to at least one of the side panels by means of straps.

3. A bag as claimed in claim 2, wherein the upper surface of each tubular member is provided with a slot or cut-out portion adjacent each end, a strap being received in each slot and at least the top portion of each of the said straps being disposed inside a tubular member, so that when the tines of a fork-lift truck are inserted into the tubular members under the top portions of the straps and lifted, the weight of the bag will be carried by the straps.

4. A bag as claimed in claim 1, wherein each tubular member is disposed along substantially the entire length of the top edge of a side panel.

5. A bag as claimed in claim 4, wherein the tubular members extend longitudinally beyond the edges of the side panels along which they are disposed.

6. A bag as claimed in claim 1, wherein the tubular members are reinforced with a rubber material.

7. A bag as claimed in claim 1, which is of generally square or rectangular plan section.

8. A bag as claimed in claim 1, wherein the bag may be lifted by means of the tubular members.

9. A collapsible bag for the storage and transport of bulk materials, the bag having a generally square or rectangular plan section and being provided with a pair of tubular members each secured to and disposed along a substantial length of an opposite top edge thereof and connected together by rigid spacing means at or adjacent to their ends, whereby the bag may be lifted by means of the tubular members, characterised in that the tubular members are resilient so that they lie flat when under load but revert to a predetermined sectional shape when the load is removed.

10. A device for securing to a collapsible bag for the storage and transport of bulk materials, the bag comprising a bottom panel, a plurality of side panels, and a plurality of straps or lifting loops for lifting the bag, the device comprising a pair of substantially parallel tubular guide members which are connected together at or adjacent to each end by rigid spacing means, the tubular members being resilient so that they lie flat when under load but revert to a predetermined sectional shape when the load is removed.

11. A device as claimed in claim 10, wherein each tubular member has a slot or cut-out portion adjacent each end for receiving a portion of a strap or lifting loop of a bag.

12. A method of manufacturing a bag for the storage and transport of bulk materials, the bag having a bottom panel and a plurality of side panels and being provided with a pair of substantially parallel tubular members each secured to and disposed along the top edges of a pair of opposed side panels; the method comprising forming the bag with one pair of opposed sides which are longer than the other sides, securing the free end of each extra-length side to that side so as to form a tubular member, providing each tubular member with a resilient reinforcement and connecting the tubular members together at or adjacent each end by substantially rigid connecting means.

13. A method as claimed in claim 12, wherein the resilient reinforcement comprises a rubber reinforcing member.

14. A method as claimed in claim 12, wherein the resilient reinforcement is provided by placing each tubular member on a former to define a shape of the tubular member; and spraying the tubular member with a fluid material that dries to a form-retaining coating to retain it in that shape.

15. A method as claimed in claim 14, wherein the fluid material is a foam or lacquer.

* * * * *